US005106062A

United States Patent [19]

Sergio

[11] Patent Number: 5,106,062

[45] Date of Patent: Apr. 21, 1992

[54] MODULAR APPARATUS FOR PRODUCING METAL ALLOYS IN SEMI-LIQUID OR PASTE-LIKE STATE

[75] Inventor: Abis Sergio, Novara No, Italy

[73] Assignee: Stampal, S.p.A., Caselette, Italy

[21] Appl. No.: 681,336

[22] Filed: Apr. 5, 1991

[30] Foreign Application Priority Data

Apr. 12, 1990 [IT] Italy ..... 20019 A/90

[51] Int. Cl.[5] ..... C21C 7/00

[52] U.S. Cl. ..... 266/233; 420/590

[58] Field of Search ..... 266/233; 420/590

[56] References Cited

U.S. PATENT DOCUMENTS 3,948,650 4/1976 Flemings ..... 420/590

3,951,651 4/1976 Mehrabian ..... 420/590

FOREIGN PATENT DOCUMENTS 0013700 8/1980 European Pat. Off. .

2037634 7/1980 United Kingdom .

OTHER PUBLICATIONS

European Search Report conducted in application No. EP 91 10 5313.

*Primary Examiner*—Peter D. Rosenberg

*Attorney, Agent, or Firm*—Collard, Roe & Galgano

[57] ABSTRACT

Apparatus for producing metal alloys in semi-liquid or paste-like state, constituted by a plurality of modular elements (1*a*—1*b*—1*c*, and so forth), each of which is formed by an elongated hollow body with two mutually opposite open faces, transversely to which through-tubes 8—8*a*—8*b* are inserted, which tubes can be connected with an external source of controlled-circulation coolant liquid, such as a diathermic liquid, or air mixed with atomized water.

9 Claims, 3 Drawing Sheets

FIG. 5
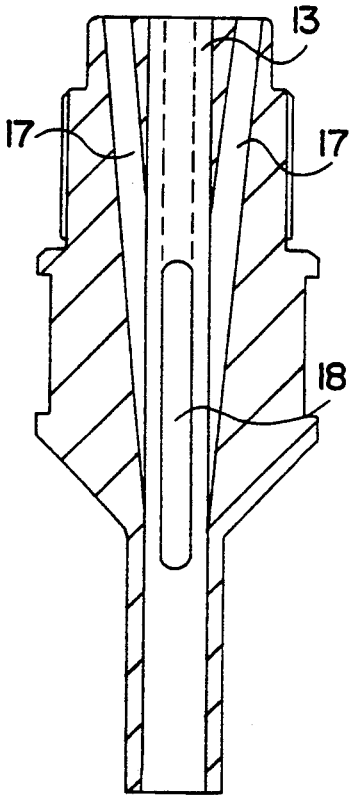
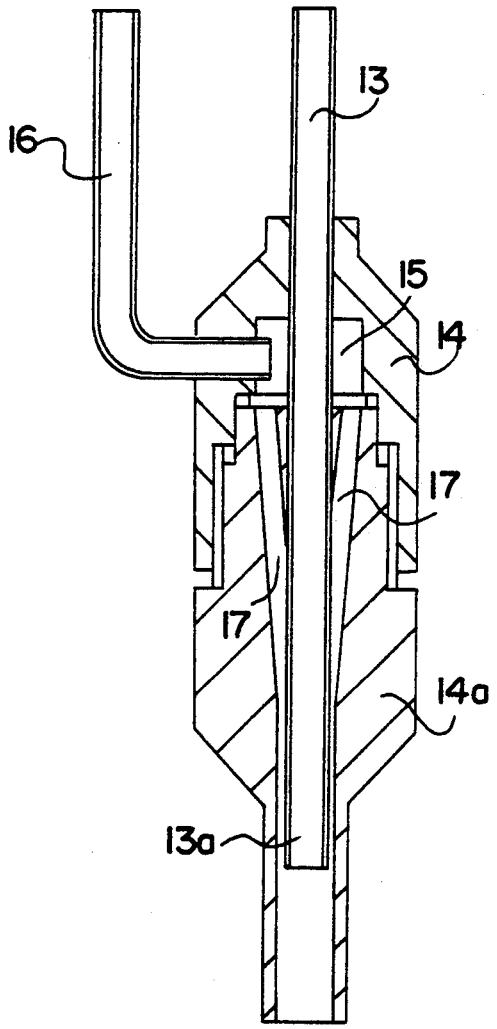
FIG. 4

MODULAR APPARATUS FOR PRODUCING METAL ALLOYS IN SEMI-LIQUID OR PASTE-LIKE STATE

DESCRIPTION

The present invention relates to an apparatus with modular structure, suitable for producing, by means of a controlled cooling, and under stirring, metal alloys of aluminum, copper, magnesium and the like, in a semi-liquid or paste-like state, useable in processes of fabrication of formed articles by pressure die-casting, gravity casting, and the like.

Various types of processes and apparatuses capable of changing the state of metal alloys, besides into the liquid state or solid state, also into a low-viscosity semi-liquid, paste-like state, useable in the molding processes have already been described.

The traditional processes of solidification used in order to turn metal alloys into a partially solid state are known to generate within the metal mass a branched, dendritic, intimately interlaced structure having high stiffness values even with low levels of solids; therefore, in practice, all attempts to homogeneously deform this structure, constituted by a liquid mass supported by a plurality of dendrites, generate in the formed articles, chill cracks, or high-segregation regions, which do not allow undamaged formed articles having the required shape to be obtained.

In order to obviate these drawbacks, i.e., to eliminate the formation of branched dendritic structures during the solidification, keeping the liquid bath with vigorous stirring during the solidification has already been proposed.

In this way, a partially solidified alloy could be obtained, in which the dendrites result to have a spheroidal shape, which is such as to be capable of being submitted to forming both by casting, as soon as produced (pressure die-casting, gravity casting, low-pressure casting, and so forth), and by plastic deformation, after solidification and subsequent partial re-smelting, in all cases formed articles being obtained, which are practically free from cracks and/or microsegregations, and with smaller shrinkages during the solidification of the cast piece.

The processes known from the prior art to obtain a semi-liquid or paste-like metal alloy are many. The so-called "Rheocasting" process uses a cooled cylindrical rotary mixer, with an alloy-dragging rotor coaxial with the axis of the mixer; another process uses static mixers comprising, in certain cases, a cylindrical container inside the interior of which stretches of helical elements with alternatively reversed pitch and, in other cases, a column of plate-shaped elements are provided, inside which radial channels converging towards, and diverging from, a hollow provided in the centre of the container, are provided.

These mixers have a complex and expensive structure, and are difficult to service.

A particular static mixer to obtain semi-liquid metal alloys suitable for forming processes based on pressure die-casting, and the like, is also known, which is substantially constituted by a vertical-axis container body, coaxially inserted in another, isolated container, such as to create a continuous space between said two containers, to allow a coolant fluid to be circulated. Inside the innermost container body, spheroidal bodies having different diameters, made of a refractory material, and another high-temperature-resistant material are packed in random arrangement; between said spheroidal bodies, a plurality of mixing channels intercommunicating with one another are formed, which enable the liquid metal alloy, fed from the upper end of the container containing said spheroidal bodies, to flow with a high shear gradient, without turbulence, with it undergoing, during its cooling, high induced shear stresses, capable of preventing branched dendrites from growing up and aggregating.

Although it makes possible the desired process parameters to be maintained with constance and repeatibility, in practice this type of static mixer shows the drawback that it does not enable the cooling to be uniformly distributed throughout the bulk of the spheroidal bodies, owing to the considerable diameter of the column of spheres; in other terms, the temperature gradient of the alloy during the solidification step does not remain constant up to such an extent as to enable one to operate on the process parameters in the desired way.

Therefore, a purpose of the present invention is of providing an apparatus for producing, by cooling under simultaneous stirring, metal alloys in a low-viscosity, semi-liquid or paste-like state, with said apparatus having such a structure as to result to be highly versatile and reliable, and to make it possible, thanks to its structure, consisting of modular elements, increases or decreases in production to be achieved, according to any requirements, in an easy and quick way, as well as the percentage of solid to be varied according to the type of paste-like alloy required, by varying the number of the components of the structure, and the cooling conditions.

Another purpose of the invention is of providing an apparatus of the above specified type, substantially a static mixer consisting of easy-to-be-assembled modular elements, with such a structure as to make it possible a pre-established temperature gradient to be obtained for the alloy during the solidification step, and therefore such as to enable one to operate on the various process parameters in an always correct way, and thus obtain the required ratio of the concentration of the solid phase to the concentration of the liquid phase.

A further purpose of the invention is of providing a static mixing apparatus simple and easy to be serviced, and also capable of being used with its axis being either in vertical or horizontal position, or also in an inclined position, with evident advantages as regards the possibility of installation on considering the available spaces.

Still another purpose is of providing an apparatus capable of producing semi-liquid or paste-like metal alloys, from alloys of various types and compositions, having a rather wide solidification range.

These and still further purposes of the invention, which will be evidenced more clearly by the following disclosure, are achieved by an apparatus for producing metal alloys in semi-liquid or paste-like state, by means of a controlled cooling under simultaneous stirring, which apparatus is constituted, according to the present invention, by a plurality of modular elements in form of box-like elements which can be coupled with one another with tight sealed couplings, each of which modular elements is formed by a box-like body substantially having the shape of an elongated parallelepipedon, with two mutually opposite longitudinal open faces, transversely to which through-tubes are inserted, which tubes can be connected, with possibility of disengagement, with an external source of controlled-circulation coolant liquid, the coupling of said plurality of modular, hollow elements being accomplished by causing the open sides of each modular element to come to rest against each other, and said modular elements being fastened to one another, with a tightly sealed coupling being accomplished, by tightly joining opposite flanges with bores provided at the ends of each modular element, in such a way as to obtain one single hollow body inside which the external surfaces of said cooling tubes define a plurality of mixing channels intercommunicating with one another and orientated in different directions, thus allowing the metal alloy in the liquid state, fed at an open end of said assembled sole hollow body, to flow with a high shear gradient, simultaneously undergoing high shear stresses, during its cooling.

Said coolant fluid can be constituted by a diathermic liquid, air mixed with atomized water, or other media. More particularly, said modular elements are preferably provided with a same number of cooling tubes, and are coupled with each other in diagonal layout relatively to the axis or direction of feed of the liquid alloy, in order to generate a larger number of internal branched channels, and greater differences in the surface-areas or cross-section of the same channels between adjacent tubes.

Further characteristics and advantages of the invention will be clearer from the following disclosure in detail of a preferred, non-exclusive form of practical embodiment thereof, which disclosure is made by referring to the accompanying drawing tables, supplied for merely indicative, non-limitative purposes, in which:

FIG. 3 shows a partial sectional view of the modular element of FIG. 2, while FIGS. 4 and 5 show two different types of spraying nozzles useable to feed coolant fluid into the modular elements as shown in FIGS. 1, 2 and 3.

Figure 1:
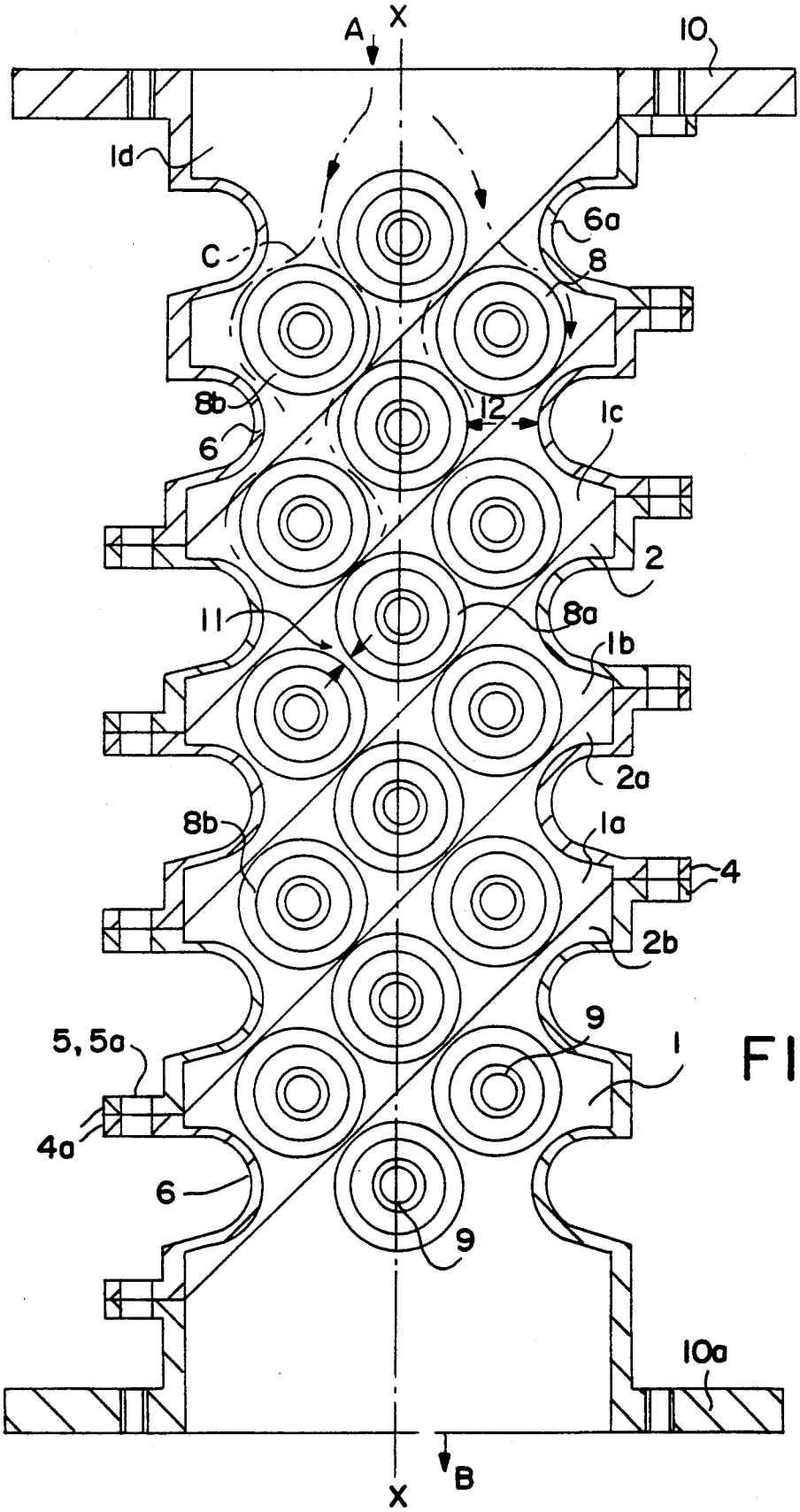
FIG. 1 shows a top, or plan, view of a modular, static mixer apparatus, realized according to the invention.

Referring to said figures, and, in particular, to figures from 1 to 3, the apparatus of the present invention is constituted by coupling, in the longitudinal direction, a plurality of elongated box-like bodies, indicated with 1*a*–1*b*–1*c*, etc., in FIG. 1, each of said elements being defined by the peripheral lines 2–2*a*, which represent the sides along which the various bodies are coupled with each other. The hollow bodies 1*a*–1*b*–1*c* are modular, in that they are used with same dimensions and be indifferently coupled in two opposite positions.

Figure 2:
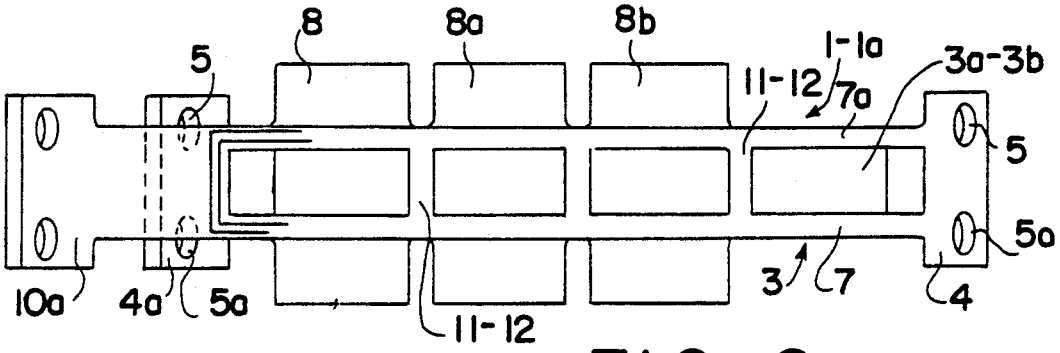
FIG. 2 shows a side view of a modular component (the outermost one), suitable for accomplishing, by coupling with other equal elements, the apparatus of FIG. 1.
Figure 3:
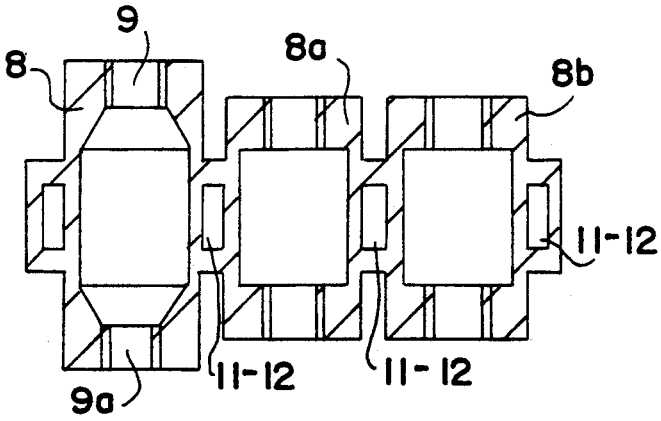

More precisely, each modular box-like body is constituted (FIGS. 2–3) by a container 3 of parallelepipedal shape provided, at its opposite ends, with a pair of flat flanges 4–4*a*, with bores 5–5*a* for said body's coupling, in stack fashion, with other equal bodies, as is better explained in the following. Each box-like body 1*a*–1*b*–1*c* etc. is furthermore open at both its opposite longitudinal faces 3*a* and 3*b* (corresponding to the coupling lines 2–2*a* of FIG. 1), while their front faces are closed by inwards arcuate walls, as indicated with 6–6*a* in FIG. 1.

Perpendicularly to the opposite closed faces 7–7*a*, through-tubes or sleeves 8–8*a*–8*b* etc. are inserted, which are provided with inlet openings 9–9*a*, preferably threaded and connected with an external source of coolant fluid continuously circulating under controlled conditions, such as, e.g., water atomized by pressurized air, diathermic liquid, or other media.

A plurality of said modular hollow bodies are then assembled together by juxtaposing the opposite open faces of the individual bodies 1*a*–1*b*–1*c* etc. to each other, and then fastening the individual bodies to each other, in stack fashion, with tightly sealed couplings, by means of tie-rods inserted through the bores 5–5*a* of said pairs of flanges or connecting surfaces 4–4*a* protruding from the ends of the individual bodies.

The stack of modular elements 1*a*–1*b*–1*c* etc. is closed at its opposite ends by a modular element 1–1*d*, of substantially triangular shape and so contoured as to constitute an inlet "A" and an outlet "B" for the metal alloy to be processed; each of said opposite elements 1–1*d* furthermore has a large flange 10 and 10*a*, to which the tie-rods (not depicted), which keep assembled the stack of modular bodies, are stably anchored. Furthermore, according to the invention, the individual modular bodies are arranged in diagonal layout (FIG. 1) relatively to the direction of feed "A" of the liquid alloy, i.e., relatively to the central axis "X" of the stack of modular elements.

In this way, the individual tubes 8–8*a*–8*b* of each modular body are staggered and closer, to each other, than they would do if the hollow bodies 1*a*–1*b*–1*c*. etc. were parallel to each other and perpendicular to the central axis "X". This arrangement enables the arcuate end walls 6–6*a* to enter the space between, and come closer to, the outermost tubes, consequently behaving as if they were portions of tubes 8.

This arrangement in stack fashion makes it possible a large single hollow to be created, which is constituted by the total of the hollows of the various side-by-side box-like bodies fastened to each other by tightlysealed couplings, while the plurality of cooling tubes 8 create, inside said single hollow, passage-ways (for the alloy fed through the inlet "A") having cross-sections 11 with surface-area different from the surface-area of the other passage-ways 12 between adjacent tubes. Thus, by placing the cooling tubes in different relative positions, and varying the number of tubes in each modular element, one can create a plurality of mutually intercommunicating mixing channels with different dimensions and orientated according to different directions, such as to enable the liquid alloy, fed at the end "A" (FIG. 1), to flow with a high shear gradient, without turbulence, and also to undergo high induced shear stresses, during its cooling, such as to prevent branched dendrites from growing up and aggregating.

The path of the molten alloy, fed at the inlet "A" of the apparatus, is partially illustrated with chain lines, as indicated with "C" in FIG. 1. Obviously, in practice, the dimensions of the individual modular bodies, and the number of cooling tubes in each body can vary according to any use requirements.

Furthermore, the above disclosed apparatus can be used either in vertical direction, i.e., as a tower, or in horizontal direction, as well as in an inclined position; such possibilities are advantageous in order to be able to adequately adapt the overall dimensions of the apparatus to the actually available room.

Thus, it was also observed that by using cooling tubes 8–8*a* etc., with tapered inlet ends (FIG. 3), the flowing of the coolant fluid is made more effective. Furthermore, in order to accomplish the atomization of water by pressurized air, it was observed that such atomizer nozzles as those represented in sectional view in FIGS. 4 and 5, i.e., devices based on the Venturi tube principle, are particularly advantageous.

So, the device of FIG. 4 can be accomplished by means of a tube 13, axially running through a support constituted by two separate bodies 14–14*a* and an annular chamber 15 between them, into which tube water to be atomized is fed, and then injecting pressurized air into the chamber 15, through a tube 16 orientated in axial direction relatively to the tube 13. The chamber 15 is then put into communication with the interior of the tubes 8 through ducts 17, preferably four tubes, converging towards the outlet end 13*a* of the water tube 13, so as to cause water to be atomized at the inlet of the same tubes 8.

In FIG. 5 an atomizer device is illustrated, which also can be directly associated with the cooling tubes 8, analogous to the preceding atomizer device, in which inside the water tube 13 there is positioned an elongated diverting body 18 against which the water stream and the four convergent tubes 17 for pressurized water are directed, so as to cause water to be atomized at the lower end of the diverting body.

The above disclosed apparatus makes it possible semi-liquid or paste-like alloys to be produced by starting from liquid metal alloys having a rather wide solidification range, and anyway different from zero. Furthermore, its particular, modular, structure, consisting of prearranged modular elements with cooling tubes of different sizes and present in different numbers according to any particular requirements, makes said apparatus, as already mentioned, a highly versatile one; and the servicing results simple and fast as well, independently from the size of the modular bodies.

The junctures between the various modular elements are tightly sealed, so that, even in case an unevenness between the contacting surfaces occur, with consequent spillage of metal in the liquid state, such danger conditions would not arise, which would be caused by the contact between the molten metal, and the coolant liquid.

Finally, in practice, to the invention as disclosed and illustrated hereinabove, further modifications and variants may be supplied, which are structurally and functionally equivalent, without departing from the scope of protection of the same invention.

It is claimed:

1. Apparatus for producing metal alloys in semi-liquid or paste-like state, with a controlled cooling means and simultaneous stirring means comprising:

a plurality of modular, hollow box-like elements which are coupled with one another with tight sealed couplings, each of which modular elements is formed by a box-like body substantially having the shape of an elongated parallelepiped, with two mutually opposite longitudinal open faces;

cooling through tubes being inserted transversely to said mutually opposite longitudinal open faces, which tubes are connected with, or disengaged from an external source of controlled-circulation coolant liquid;

means for coupling said plurality of modular, hollow elements causing the open sides of each modular element to come to rest against each other;

means for fastening said modular elements to one another, with a tightly sealed coupling being opposite flanges with bores tightly joined and provided at the ends of each modular element, in such a way as to obtain one single hollow body inside of which the external surfaces of said cooling tubes define a plurality of mixing channels intercommunicating with one another and orientated in different dirrections; and thus allowing the metal alloy in the liquid state, fed at an open end of said assembled single hollow body, to flow with a high shear gradient, simultaneously undergoing high shear stresses, during its cooling.

2. Apparatus according to claim 1, comprising:

said modular, box-like elements having the same dimensions and being coupled with one another, with tight-sealed coupling; and said modular box-like element positioned in diagonal layout relatively to the direction of feed of the liquid alloy.

3. Apparatus according to claim 1, comprising:

each box-like element having opposite ends; said opposite ends made as an inwardly arcuate head, in order to define bent surfaces close, and substantially equal, to the surfaces of the adjacent cooling tubes.

4. Apparatus according to claim 2, further comprising:

end modular elements in the structure having an external substantially triangular shape, in order to be capable of being coupled with the modular elements in the diagonal layout and constitute the inlet mouth for the liquid alloy and constitute the outlet mouth for the semi-liquid alloy; and protruding flanges being associated with said inlet mouth and outlet mouth which are suitable for constituting the anchoring means for tie-rods which connect and keep fastened the stack of modular elements.

5. Apparatus according to claim 1, comprising:

said cooling tubes running perpendicularly through said modular box-like elements and said tubes having opposite ends, which constitute the inlet opening and outlet opening for the coolant fluid, tapered and threaded, said taper increasing the flow of the coolant fluid inside the tubes.

6. Apparatus according to claim 1, comprising:

means for providing a diathermic liquid as the coolant fluid.

7. Apparatus according to claim 1, comprising:

means for providing air mixed with atomized water as the coolant fluid.

8. Apparatus according to claim 5, further comprising:

an atomizer or nebulizer device associated with the tapered inlet of each cooling tube; and said device which is constituted by a support axially incorporating a pipe connected with a water source and at least four ducts connected with a source of pressurized air and converging towards the outlet end of said water feeding pipe, so as to create an effective nebulization of water at the same inlet of the cooling tubes.

9. Apparatus according to claim 1, further comprising:

means for enabling said assembled single hollow body to be used in vertical, horizontal or inclined direction.

* * * * *